United States Patent [19]

Shire

[11] Patent Number: 5,074,069

[45] Date of Patent: Dec. 24, 1991

[54] SLING SWIVEL

[76] Inventor: Michael H. Shire, 19 E. Main St., Belgrade, Mont. 59714

[21] Appl. No.: 674,586

[22] Filed: Mar. 25, 1991

[51] Int. Cl.[5] ..... F41C 23/02

[52] U.S. Cl. ..... 42/85

[58] Field of Search ..... 42/85; 24/265 R, 265 AL; 224/150, 913

[56] References Cited

U.S. PATENT DOCUMENTS 4,505,012 3/1985 Johnson ..... 42/85

4,713,905 12/1987 Dupuy ..... 42/85

*Primary Examiner*—Charles T. Jordan

*Attorney, Agent, or Firm*—Zarley, McKee, Thomte, Voorhees & Sease

[57] ABSTRACT

A sling swivel for facilitating the attachment of a sling to a rifle comprising a substantially flat body member constructed of a polymeric material or the like. The body member has a cut-out portion at its upper and which receives the swivel stud extending downwardly from the rifle. An attachment bolt extends through a bore formed in the upper end of the body member and has a polymeric bushing mounted thereon which is received in a bore formed in the swivel stud.

3 Claims, 1 Drawing Sheet

SLING SWIVEL

BACKGROUND OF THE INVENTION

This invention relates to a rifle sling swivel, in more particularly to a rifle sling swivel which does not squeak or rattle.

Rifle slings are conventionally secured to rifles by means of swivels connected to the front and rear portions of the sling. Historically, the swivels have been constructed of metal material and the conventional metal swivels squeak and rattle in the field which can alert wildlife to the presence of the hunter. Further, the conventional metal swivels frequently rust It is therefore a principal object of the invention to provide an improved sling swivel.

The further object of the invention is to provide a sling swivel which is constructed of a material that will not squeak or rattle.

Still another object of the invention is to provide a sling swivel which is constructed of a polymeric material or the like.

Still another object of the invention is to provide a sling swivel including a body member which is constructed of a polymeric material or the like and which has a polymeric bushing or the like positioned between the rifle swivel stud and the sling swivel.

Yet another object of invention is to provide a sling swivel which is economical of manufacture, durable in use and refined in appearance.

These and other objects will be apparent to those skilled in the art.

SUMMARY OF THE INVENTION

Figure 1:
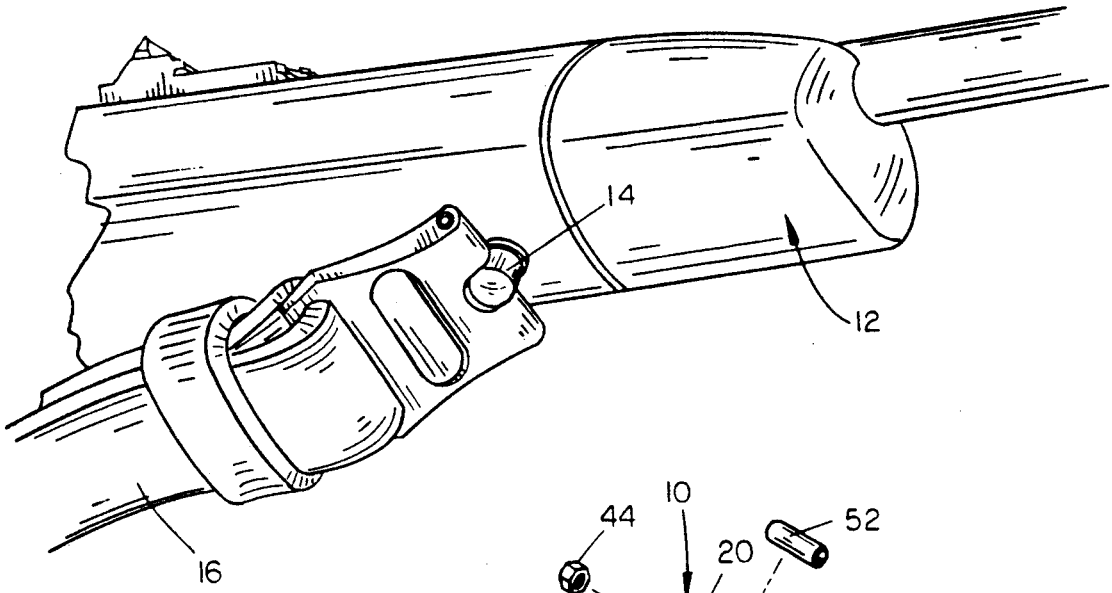
FIG. 1 is a perspective view illustrating the sling swivel of this invention.
Figure 2:
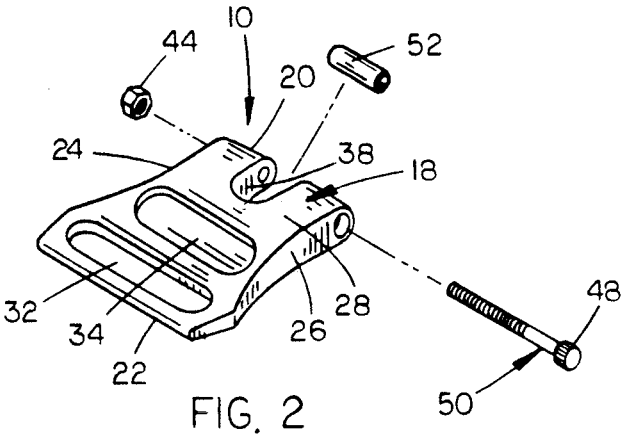
FIG. 2 is an exploded perspective view of the sling swivel of this invention.
Figure 3:
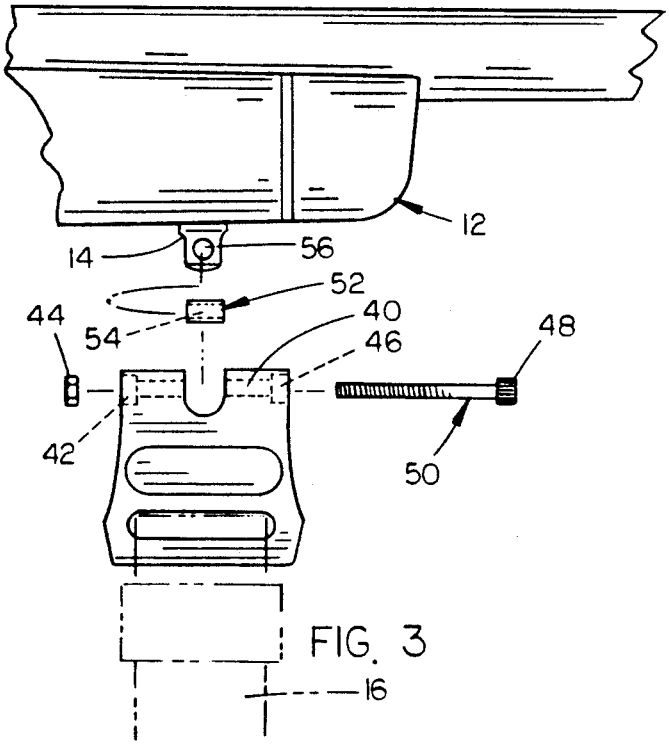
FIG. 3 is an elevational view of the sling swivel.
Figure 4:
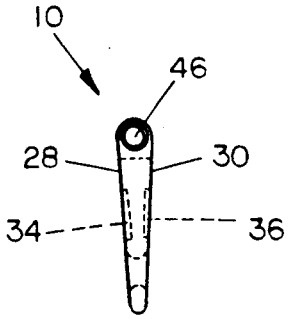
FIG. 4 is a side view of the sling swivel of this invention.

The sling swivel of this invention is comprised of a substantially flat body member which is constructed of a polymeric material or the like and which has upper and lower ends, opposite side edges, and opposite sides. The lower end of the swivel is provided with an elongated slot formed therein which receives one end of the sling. The upper end of the body member is provided with a U-shaped cut-out area which is adapted to receive the lower end of the rifle swivel stud. An elongated bore extends through the upper end of the body member and communicates with the U-shaped cut-out area. An elongated attachment bolt is positioned in the bore and has a polymeric bushing positioned thereon in the U-shaped cut-out area. The bushing is positioned between the attachment bolt and the swivel stud. In use, the polymeric construction of the body member and the bushing prevents the swivel from squeaking or rattling. Further, the construction of the device prevents rusting.

DESCRIPTION OF THE PREFERRED EMBODIMENT

The sling swivel of this invention is referred to generally by the reference numeral 10 while the reference numeral 12 refers to a conventional rifle having a conventional swivel stud 14 extending downwardly from the front portion of the rifle stock. It should be noted that a swivel stud will also be provided at the butt end of the rifle. The numeral 16 refers to a conventional rifle sling which would normally be secured to the swivel studs by a metallic swivel plate or the like.

Sling swivel 10 is comprised of a substantially flat body member having an upper end 20, lower end 22, opposite side edges 24 and 26, and opposite sides 28 and 30.

Body member 18 is provided with an elongated slot 32 formed therein adjacent its lower end which is adapted to receive the rifle strap 16 as illustrated in FIG. 1. Body member 18 is also provided with recessed areas 34 and 36 at its opposite sides which may be used for logos, decals, etc. Body member 18 is provided with a U-shaped cut-out area 38 formed in its upper end which is adapted to receive the lower end of the swivel stud 14 as illustrated in FIG. 1. Body member 18 is also provided with an elongated bore 40 which extends therethrough and which communicates with the cut-out area 38 as illustrated in the drawings. One end of bore 40 is enlarged at 42 to receive nut 44 The other end of bore 40 is enlarged at 46 to receive the head 48 of attachment bolt 50. The numeral 52 refers to a polymeric bushing having bore 54 formed therein which is adapted to receive attachment bolt 50.

Strap 16 is secured to the sling swivel 10 so that the strap extends through opening 32. Sling swivel 10 is connected to the stud 14 by positioning bushing 52 in the bore 56 of stud 14. Bore 40 is then aligned with opening 56 and the attachment bolt 50 is extended through the bore 40 and the bore 54 of bushing 52. The bolt 50 is then threadably secured to nut 44.

By constructing the bushing 52 and the body member 18 of a polymeric material or the like, the same will not squeak or rattle when the hunter is using the same. The fact that the sling swivel is quiet ensures that wildlife will not be startled as the hunter manipulates the firearm. The polymeric construction of the body member 18 and the bushing 52 ensures that the same will not rust.

Thus, it can be seen that a novel sling swivel has been provided which accomplishes at least all of its stated objectives.

I claim:

1. A sling swivel comprising, a substantially flat body member having opposite sides, an upper end, a lower end, and opposite side edges, said body member being comprised of a polymeric material or the and having an elongated slot formed in its lower end for receiving a sling strap therein, said body member having a cut-out portion formed in its upper end for receiving a swivel stud therein, said body member having an elongated bore formed therein extending between the opposite side edges thereof at the upper end thereof and which communicates with said cut-out portion, an attachment bolt means positioned in said elongated bore, a bushing mounted on said attachment bolt in said cut-out portion, said bushing being adapted to be received by the swivel stud, said bushing being comprised of a polymeric material.

2. The sling swivel of claim 1 wherein one end of said elongated bore is enlarged to receive the head portion of the attachment bolt means and wherein the other end of said elongated bore is enlarged to receive a nut therein for threadable attachment to said attachment bolt means.

3. In combination with a rifle having a pair of swivel studs secured thereto and extending downwardly therefrom, each of said studs having a horizontal disposed bore formed therein, comprising, a sling swivel secured to each of said studs, and a sling secured to and extending between said sling swivels, each of said sling swivels comprising a substantially flat body member having opposite sides, an upper end, a lower end, and opposite side edges; said body member being comprised of a polymeric material and having an elongated slot formed in its lower end for receiving a sling strap herein; said body member having a cut-out portion formed in its upper end for receiving one of said swivel studs therein, said body member having an elongated bore formed therein extending between the opposite side edges thereof and the upper end thereof and which communicates with said cut-out portion, an attachment bolt means positioned in said elongated bore, a bushing mounted on said attachment bolt in said cut-out portion, said bushing being received by the bore of the swivel stud, said bushing being comprised of a polymeric material.

* * * * *